United States Patent [19]

Giles et al.

[11] Patent Number: 4,918,888

[45] Date of Patent: Apr. 24, 1990

[54] CHINKING CLOSURE SYSTEM FOR LOG STRUCTURES

[75] Inventors: Randy K. Giles; Gordon H. Lucas, both of Jefferson County, Tenn.

[73] Assignee: Hearthstone Builders, Inc., Dandridge, Tenn.

[21] Appl. No.: 161,748

[22] Filed: Feb. 29, 1988

[51] Int. Cl.[5] ..... E04B 1/10

[52] U.S. Cl. ..... 52/233; 52/586; 52/220

[58] Field of Search ..... 52/233, 286, 586, 220, 52/221; 403/294, 220, 225, 291

[56] References Cited

U.S. PATENT DOCUMENTS

| | | | |
|---|---|---|---|
| 3,527,005 | 9/1970 | Slavens | 52/586 X |
| 4,185,428 | 1/1980 | Boucquey et al. | 52/233 |
| 4,649,683 | 3/1987 | Dolata | 52/233 |

*Primary Examiner*—David A. Scherbel

*Assistant Examiner*—Creighton Smith

*Attorney, Agent, or Firm*—Pitts and Brittian

[57] ABSTRACT

An improved chinking closure system (10) is provided for adjacent logs in a log structure. The closure system (10) comprises a compressible block member (28) which is inserted into a chink (12) defined between adjacent logs. The block member (28) has a longitudinal axis which is substantially parallel with the longitudinal axis of each of the logs defining the chink. In the preferred embodiment, first and second closure members (46-and 46'), each have an upper portion which is releasably connected to the lower portion of the first log, and each having a lower portion which is releasably connected to the upper portion of the second log. These closure members are mounted on opposite sides of the compressible block (28) which is enclosed within the chamber defined between the closure members, and the upper and lower logs.

8 Claims, 2 Drawing Sheets

CHINKING CLOSURE SYSTEM FOR LOG STRUCTURES

TECHNICAL FIELD

This invention relates to log structures, and more particularly is directed to a chinking closure system in such structures.

BACKGROUND ART

In the construction of log structures, logs of adjoining walls are generally interlocked to form corner joints. To accomplish this, the ends of the logs are notched to receive the end portions of logs of an intersecting wall, with intersecting logs being alternatively stacked such that the adjoining walls interlock. In conventional log structures, chinks are developed between adjacent logs in a particular wall, or more specifically, between the lower portion of a log and the upper portion of an adjacent log forming the same wall. As a result, it is important for aesthetic and insulative purposes to close the chinks between adjacent logs.

In an attempt to form such closures, it has heretofore been known to provide masonite panels which are mounted for closing the chinks between adjacent walls. These panels traditionally close the portion of the chinks proximate the exterior surfaces of the logs while leaving the interior of the chink space open. Normally, this space is filled with insulation of various types. However, as the logs of the wall dry, spaces can develop between the walls and the insulation which deleteriously affect the insulation quality. Moreover, with certain conventional systems, it is difficult to wire the structure after the insulation has been inserted into the chinks.

Therefore, it is an object of the present invention to provide an improved chinking closure system for adjacent logs in a log structure.

It is a further object of the present invention to provide such an improved chinking closure system which can be easily manufactured and installed in stages which allow the exterior of the log structure to be completed while the interior of the structure continues to dry prior to completing the structure wiring.

Yet another object of the present invention is to provide such a chinking closure system which can be readily adapted for receiving the structure wiring in the chamber defining between the closure members and adjacent logs.

The construction time is reduced by usage of the present invention since the textured finish (perma-chink in the preferred embodiment) on the closure members is preferably pre-applied. the aesthetics of the structure are also improved.

DISCLOSURE OF THE INVENTION

Other objects and advantages will be accomplished by the present invention which provides an improved chinking closure system for closing and insulating the chinks between adjacent logs in a log structure. The chinking closure system of the present invention comprises a compressible block member which is designed for being inserted into the chink defined between the adjacent logs. The block member has a longitudinal axis which is substantially parallel with the longitudinal axis of each of the logs and a width which is less than the width of the log. At least one closure member defines an upper portion which is releasably connected to the lower portion of the upper log. This closure member also defines a lower portion which is releasably connected to the upper portion of the lower log. In the preferred embodiment, the lower portion of the upper log, the upper portion of the lower log, and first and second elongated closure members define a chamber into which is inserted the compressible block member which serves to insulate the chamber. This block member can be readily adapted in the preferred embodiment to receive the log structure wiring.

BRIEF DESCRIPTION OF THE DRAWINGS

The above-mentioned features of the present invention will become more clearly understood from the following detailed description of the invention read together with the drawings in which.

BEST MODE FOR CARRYING OUT THE INVENTION

Figure 1:
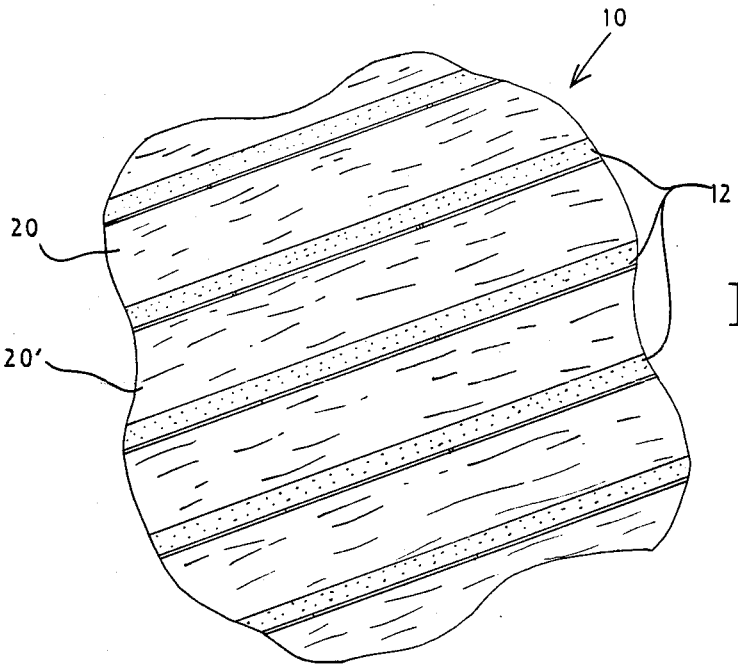
FIG. 1 illustrates a surface view of a chinking closure system constructed in accordance with various features of the present invention.

Referring now to the drawings, an improved chinking closure system constructed in accordance with various features of the present invention is described generally at 10. More specifically, the chinking closure system 10 is designed for closing a chink 12 defined between adjacent pairs of logs 14 and 16. These logs are vertically disposed with respect to each other, that is one is positioned above the other to form a wall of a log structure. Each of the logs has an elongated body of preselected length along its longitudinal axis. Each log has an upper portion and a lower portion and further defines a width along its transverse axis 18 which terminates in a first exterior surface 20 and a second exterior surface 22. The logs are arranged such that the lower portion 24 of the first log 14 is juxtaposed and spaced from the upper portion 26' of the second log 16 such that the chink 12 is defined therebetween.

In the figures, it will be noted that various portions of the logs and components of the chinking closure system 10 are similar, if not identical. For purposes of clarity, like parts are at times referred to by like but primed reference numerals. For example, 24 refers to the lower portion of log 14, and 24' refers to the lower portion of log 16.

The chinking closure system, 10' of the present invention is designed to provide insulation and fire proofing for the chink 12 defined between adjacent logs. To this end, a compressible block member 28 is provided. This block member 28 is dimensioned to fit within the chink 12 such that its longitudinal axis is substantially parallel with the longitudinal axis of the logs 14, and 16. It will also be noted that the width of the block member 28 in the preferred embodiment is less than the width indicated by arrow 18 of the log 14 which has a width substantially similar to the width of the log 16. It will also be noted that the compressible block member 28 has tapered sides 30 and 32 such that its width diminishes in the vertical direction beginning with its base 34 placed on the upper portion 26' of the lower log 16 as is illustrated in the figures. This block member 28 can extend substantially along the longitudinal axis of the adjacent logs 14 and 16; however, the chinks may can partially closed by separate lengths of a plurality of compressible block members 28, as necessary or desired. The block member 28 can be fabricated from a compressible polyurethane foam block which can be shaped to receive wiring for electrical outlets normally placed within the chink 12 within conventional log structures. For example, the block member 28 can be modified to include a bore 36 extending along the length of the block member 28. Alternatively, a portion of the block member indicated at 38 and outlined by the dotted line 40 can be removed such that the wiring of a conventional log structure employing the chinking closure system of the present invention can be placed in the space normally occupied by the block portion 38. It will, of course, be recognized that the portion of the block removed to allow conventional wiring to be placed within the chink 12 can vary.

Figure 2B:
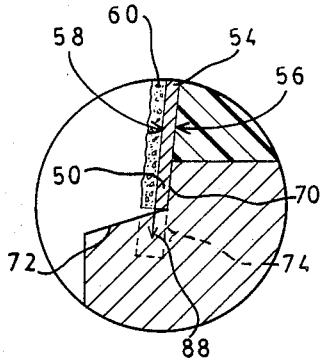
FIG. 2B illustrates a blow-up of the portion of FIG. 2A illustrated.
Figure 2A:
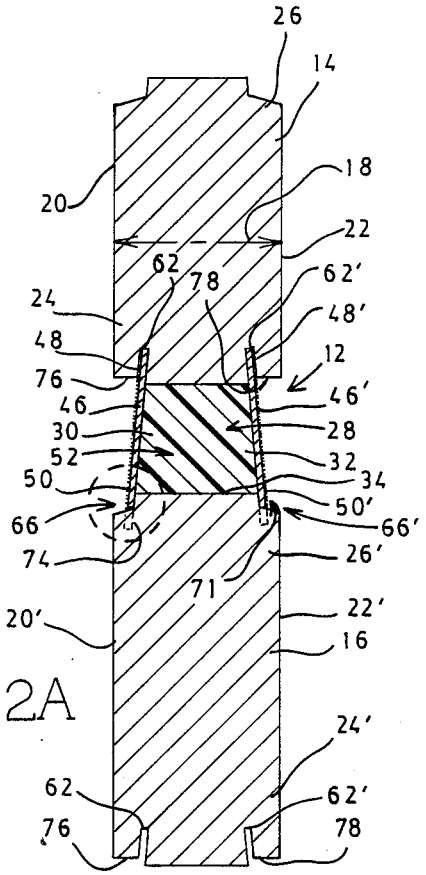
FIG. 2A is a sectional end view of the chinking closure system partially illustrated in FIG. 1.

Inasmuch as the block member 28 is compressible, it can expand and contract to a degree which allows maintenance of the seal between the lower surface of the upper log 14 and the upper surface of the lower log 16 as is illustrated in FIG. 2A. Thus, when the logs dry, as is common in log construction, the insulation value of the block member 28 remains substantially intact since it is preferably dimensioned such that it engages the adjacent logs as illustrated in FIG. 2A.

Figure 3:
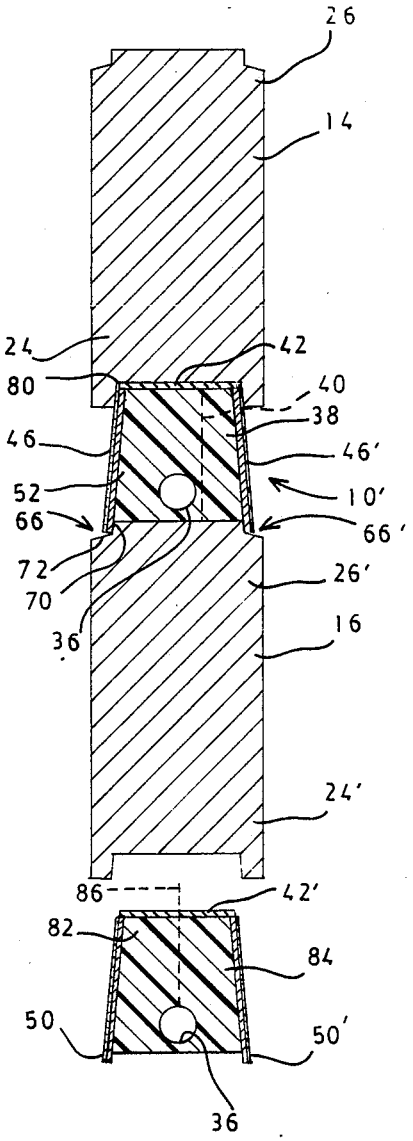
FIG. 3 is a sectional end view of a chinking closure system having certain alternate features described in greater detail herein below.

In an alternate embodiment, depicted in greater detail in FIG. 3, an elongated compressible gasket, 42 can be positioned on the upper surface of the log 14 as is shown in FIG. 3. This gasket can be fabricated from a material which is of a sufficiently compressible and/or resilient nature to maintain the seal between the lower surface of the upper log 14 and the upper surface of the block member 28. The gasket 42 shown in FIG. 3 can likewise be mounted on the upper surface of the block member 28 shown in FIG. 2A.

In accordance with another feature of the present invention, at least one closure member 46 is provided. In the preferred embodiment, a pair of closure members 46 and 46' are provided with each of these closure members having an upper portion 48 which is releasably connected to the lower portion 24 of the upper log 14. Moreover, each of these closure members 46 include a lower portion 50 which is connected to the upper portion 26' of the lower log 16.

In the embodiment depicted in FIGS. 2A and 2B, it will be noted that the lower portion of the upper log 14, the upper portion of the lower log 16, and the first and second closure members 46 and 46' define a chamber 52 which receives the compressible block member 28 therein.

These closure members 46 and 46' are preferably fabricated such that they have a substantially rigid backing 54 defining opposed planar surfaces 56 and 58 illustrated in FIG. 2B. One of the surfaces, namely surface 58, in the embodiment depicted in FIG. 2B is provided with a textured finish 60. This textured finish is designed to resemble mortar such that the log structure incorporating the closure system of the present invention appears to have its chinks filled with mortar (Also see FIG. 1). This textured finish 60 can be fabricated with a fire-rated surface to assist in retarding the spread of fire in a log structure constructed in accordance with the principles of the chinking closure system disclosed herein. Further, the closure members can be fabricated on the thin backing material with the textured finish intact and rolled for shipment to the construction site. In this connection, the closure members can be unrolled and cut to the length corresponding with the desired length of the chink desired to be covered.

Means are provided for securing the closure members 46 and 46' to the adjacent logs 14 and 16. More specifically, the securing means in the embodiment depicted in FIG. 2A comprises at least one, and in the illustrated embodiment a pair, of longitudinal grooves 62 and 62' which are defined in the lower portion of the upper log 14. More specifically, these grooves are proportioned for receiving the upper portions 48 and 48', respectively, of the closure members 46 and 46', respectively. Further, these grooves 62 and 62' can be dimensioned with a depth sufficient to allow the grooves to serve as slip joints which allows the closure members to slip into the grooves and have a selected vertical movement to compensate for vertical movement occasioned in the log 14 during drying or changes in the weather conditions.

These substantially longitudinally or horizontally disposed grooves 62 and 62' serve to releasably secure the upper portions of the closure members. Yet, as is necessary or desired, allow vertical movement of these closure members with respect to the grooves as the log dimension changes with age and drying.

The upper portion 26' of the lower log 16 includes means for supporting the lower portions 50 and 50' of the closure members 46 and 46', respectively. In the embodiment depicted in FIGS. 2A and 3, it will be noted that the upper portion of the lower log 16 is shouldered proximate its external surfaces 20' and 22', respectively, at the location generally indicated at 66 and 66'. These shouldered locations 66 and 66' define substantially vertically and horizontally disposed surfaces 70 and 72, respectively, which are proportioned for receiving the elongated closure members. These closure members can then be secured to the upper portion of the lower log 16 by a suitable nail or the like driven through an opening (not shown) provided in the lower portion of the closure members. Alternatively, suitable adhesive can be used to secure the lower portion of the closure members to the upper portion of the log 16. Further, caulking 71 can be provided to seal the lower portion of the elongated closure with respect to the upper portion of the lower log.

An alternate embodiment is illustrated in greater detail in FIG. 2B. In this embodiment, it will be noted that a further elongated groove 74 serves to receive the lower portions of the closure members for releasable securement of said closure members to the upper portion of the log 16.

It can also be noted in FIG. 2 that the lower portion of the upper log 14 can be shouldered proximate its external faces 20 and 22, respectively, across the width of the lower portion log until the grooves 62 and 62' are reached. This shouldering is indicated at the locations 76 and 78 in FIG. 2A. In an alternate construction illustrated in FIG. 3, the lower portion 24 of the upper log 14 is provided with a single groove 80 which serves to receive the upper portion of the block member 28 together with the upper portion of the closure members and the gasket 42, where a gasket is used.

In another embodiment which is designed to facilitate wiring, the block member 28 is fabricated in two pieces as is illustrated by 82 and 84 in the lower portion of FIG. 3. These two pieces are designed to mate at the location indicated by the line 86. In this manner, the exterior surface of the wall generally indicated in FIG. 1 can be completed while the inside closure member and block section 84 await installation. After proper drying has taken place, the wiring can be inserted into the opening 36 and block section 84 and closure member 46' installed to complete the log structure construction.

From the foregoing detailed description, it will be recognized that an improved chinking system for adjacent logs in a log structure has been provided. The chinking system of the present invention is designed to be aesthetically appealing, yet incorporates fire retarding and insulating features important to modern day log structures. In this regard, the chinking system includes a compressible block member 28 which is encapsulated within closure members and the upper and lower portions of adjacent logs. Further, the chinking system incorporates an insulating block means which allows continued contact with the upper and lower portions of adjacent logs even after the log dimensions change due to aging and drying. Further, in one embodiment, the lower portion of the upper log is provided with slip joints (grooves 74) allowing for ready installation of the closure members therein. These closure members are then pushed upwardly to allow the lower portion of the closure members to clear the upper portion, which is sometimes shouldered, of the lower log. Then, the closure members can be released such that the lower portion of the closure members slips into place in the longitudinally disposed groove defined in the upper portion of the lower log as shown by arrow 88. Construction speed is enhanced since the textured finish is preferably pre-applied to the closure members making insertion of the closure members a one-step installation which also improves the aesthetics of the structure.

While a preferred embodiment of an improved chinking closure system has been shown and described, it is understood that there is no intent to limit the invention to such disclosure, but rather it is intended to cover all modifications and alternate constructions falling within the spirit and scope of the invention as defined in the appended claims.

We claim:

1. An improved chinking closure system for adjacent logs in a log structure comprising:

at least a pair of logs including a first log and second log disposed below said first log, each said log having an elongated body of preselected length along its longitudinal axis and having an upper portion and a lower portion and further defining a width along its traverse axis terminating in first and second exterior surfaces, said logs being arranged such that said lower portion of said first log is juxtaposed and spaced from said upper portion of said second log such that a chink is defined therebetween;

a compressible insulation block member for insertion into said chink so as to engage said upper portion of said second log and said lower portion of said first log whereby said block member supports said first log in a selectively spaced position above said second log and provides insulation therebetween, said compressible insulating block member being provided with a bore extending longitudinally there through for receiving electrical wiring; and at least one closure member having an upper portion which is releasably connected to said lower portion of said first log and a lower portion which is releasably connected to said upper portion of said second log.

2. The improved chinking closure system of claim 1 wherein said lower portion of said first log defines a longitudinal groove proportioned for receiving the upper portion of said elongated closure member.

3. The improved chinking closure system of claim 1 wherein said closure member included a substantially rigid backing defining opposed planar surfaces, one of said surfaces being provided with a textured finish.

4. The improved chinking closure system of claim 3 wherein said textured finish resembles mortar.

5. The improved chinking closure system of claim 1 wherein said compressible block member has a width which diminishes in the vertical direction beginning with its base which is positioned on the second log.

6. The improved chinking closure system of claim 2 wherein said longitudinal groove defined in said lower portion of said log comprises a slip joint which allows said closure member to slip therein in a generally vertical direction.

7. The improved chinking system of claim 1 wherein said closure member defines a rearward surface and a lower edge and wherein said upper portion of said second log is shouldered proximate its exterior surface to define a substantially vertical surface for engaging said rearward surface of said closure member, and a substantially horizontal surface for engaging said lower edge of said closure member.

8. The improved chinking closure system of claim 1 wherein said compressible insulating block is fabricated of polyurethane foam.

* * * * *